US006604716B1

(12) United States Patent
Hoey

(10) Patent No.: US 6,604,716 B1
(45) Date of Patent: Aug. 12, 2003

(54) LAWN AND LEAF BAG HOLDER

(76) Inventor: Edison V. Hoey, 122 Aylesbury Hill, San Antonio, TX (US) 78209

( * ) Notice: Subject to any disclaimer, the term of this patent is extended or adjusted under 35 U.S.C. 154(b) by 0 days.

(21) Appl. No.: 09/918,820

(22) Filed: Aug. 1, 2001

(51) Int. Cl.[7] ..... B65B 67/04

(52) U.S. Cl. ..... 248/99; 248/100; 294/1.1; 294/1.4

(58) Field of Search ..... 248/95, 99, 101, 248/100; 294/1.1, 1.4, 1.5; 15/257.1

(56) References Cited

U.S. PATENT DOCUMENTS

| | | | | | |
|---|---|---|---|---|---|
| 1,265,996 | A | * | 5/1918 | Cerny | 248/99 |
| 2,117,689 | A | * | 5/1938 | Tatsch | 248/153 |
| 2,894,708 | A | * | 7/1959 | Kaplan | 248/99 |
| 2,917,260 | A | * | 12/1959 | Barber et al. | 248/99 |
| 3,711,141 | A | * | 1/1973 | Soergel | 15/257.8 |
| 3,733,099 | A | | 5/1973 | Szita | 294/55 |
| 3,754,785 | A | * | 8/1973 | Anderson | 294/19.1 |
| 3,810,670 | A | * | 5/1974 | Turi | 15/257.1 |
| 3,942,832 | A | | 3/1976 | Haas, Jr. | 294/55 |
| 4,012,067 | A | | 3/1977 | Travis | 294/19 R |
| 4,048,691 | A | | 9/1977 | Spangler | 15/157.1 |
| 4,159,139 | A | * | 6/1979 | Gawedzinski | 15/257.1 |
| 4,191,414 | A | * | 3/1980 | Dameron | 294/1.4 |
| 4,196,880 | A | | 4/1980 | Hynes | 248/99 |
| 4,269,441 | A | * | 5/1981 | Hirsch | 194/1.1 |
| 4,341,410 | A | * | 7/1982 | Summach | 248/99 |
| 4,548,372 | A | * | 10/1985 | Lutzker | 141/390 |
| 4,705,310 | A | * | 11/1987 | Scripter | 15/257.7 |
| 4,875,729 | A | * | 10/1989 | Peck | 15/257.4 |
| 4,962,956 | A | * | 10/1990 | Scripter | 15/257.4 |
| 5,004,195 | A | * | 4/1991 | McIntyre | 15/257.9 |
| 5,050,920 | A | * | 9/1991 | Potticary | 15/257.1 |
| 5,427,340 | A | | 6/1995 | Stromsmoe et al. | 248/97 |
| 5,676,411 | A | * | 10/1997 | Kwok | 294/1.5 |
| 6,030,010 | A | * | 2/2000 | Graeff | 248/99 |
| 6,276,645 | B1 | * | 8/2001 | Chang | 248/99 |
| 6,520,554 | B2 | * | 2/2003 | Ditzik | 294/1.1 |
| 2002/0021012 | A1 | * | 2/2002 | Roye | 294/1.1 |
| 2002/0038956 | A1 | * | 4/2002 | Ditzik | 294/1.4 |

FOREIGN PATENT DOCUMENTS

| | | | |
|---|---|---|---|
| GB | 2212383 | A | * 7/1989 |

* cited by examiner

*Primary Examiner*—Leslie A. Braun
*Assistant Examiner*—Naschica S. Morrison
(74) *Attorney, Agent, or Firm*—Jacobson Holman PLLC

(57) ABSTRACT

A lawn and leaf bag holder of one piece, wire rod construction including a triangular frame for positioning the open mouth of a plastic lawn or leaf bag, a handle extending upwardly from an apex of the triangular frame to form a handle for the bag holder and a pair of anchoring loops on each side of the frame adjacent the frame apex. The open mouth of the bag is stretched or tensioned around the triangular frame and secured with one or both of the anchoring loops. One segment of the triangular frame and bag can be positioned against or adjacent a ground surface to enable leaves, lawn debris and the like to be raked or swept into the open end of the bag while the frame and the open end of the bag are oriented in a vertical plane by a user grasping the handle to support the frame and open end of the bag in the vertical position and also enabling the bag to be moved to new positions as desired.

4 Claims, 3 Drawing Sheets

LAWN AND LEAF BAG HOLDER

BACKGROUND OF THE INVENTION

1. Field of the Invention

The present invention generally relates to a lawn and leaf bag holder for insertion into the open mouth of a standard size plastic lawn or leaf bag for maintaining the bag mouth open during collection of leaves and other lawn debris therein. More specifically, the present invention relates to a lawn and leaf bag holder of one piece, wire rod construction and including a triangular frame and a handle extending upwardly from an apex of the triangular frame to form a handle for the bag holder.

2. Description of the Prior Art

Large plastic bags are frequently used for receiving leaves, grass clippings and other lawn debris. Such plastic bags are available in most retail outlets and are typically of standard dimension. However, it is difficult to maintain the open end of such bags in an open position to enable the leaves and other material to be gathered therein. Bag holders have been provided generally in the form of a frame inserted into or engaged with the mouth of a large flexible bag in order to hold the mouth of the bag open to facilitate placement of material into the bag. The following U.S. patents known to Applicant relate to bag holders of the type discussed above:

| | | |
|---|---|---|
| 3,733,099 | 3,942,832 | 4,048,691 |
| 3,754,785 | 4,012,067 | 4,196,880 |

The above patents disclose bag holders with a frame supporting the mouth of a flexible bag which include various adjustable or movable components which require manipulation in order to effectively connect the bag to the holder to retain the bag mouth in open position in a generally vertical plane. However, the prior art fails to provide a bag holder of one piece construction without any movable or adjustable components that require manipulation by the user and can be readily installed to maintain the bag mouth open and is convenient to use during bag filling.

SUMMARY OF THE INVENTION

In order to overcome the drawbacks of the prior art, the lawn and leaf bag holder of the present invention is constructed from a single piece of substantially rigid wire rod that is bent to provide an open triangular frame and a straight, laterally extending handle at one apex thereof with the handle being disposed in the same plane as the triangular frame. The triangular frame is sized so that the open mouth of a standard flexible plastic lawn and leaf bag can be stretched or tensioned around the outer surface of the triangular frame to define a triangular opening for the bag. One segment of the triangular frame is designed to be positioned against or adjacent a ground surface while the other two sides are equal in length and the handle extends from the apex. This arrangement enables leaves, lawn debris and the like to be easily raked or swept into the open end of the bag while the frame and the open end of the bag are oriented in a vertical plane by a user grasping the handle.

The handle enables a user to hold the triangular frame in a vertical position to maintain the open mouth of the bag in a vertical position with one hand grasping the handle and the other hand being used to sweep or rake material into the open mouth of the bag. The handle also enables the bag to be quickly moved to new positions as required.

The terminal ends of the one piece wire forming the bag holder terminate in loops located and welded adjacent the juncture between the triangular frame apex and the handle. The loops are configured to each extend laterally in an inclined relation to the handle on opposite sides of the handle and frame to define included angles for anchoring the bag open mouth. This symmetrical arrangement allows the frame to neatly finish off the ends of the single rigid wire rod and permits the frame to be positioned in the open mouth of the plastic bag and the plastic bag to be stretched and secured to the frame by engaging one of the loops regardless of which side of the frame faces outwardly from the bag mouth.

Accordingly, an object of the present invention is to provide a lawn and leaf bag holder of one piece, rigid wire rod construction forming a triangular frame and a handle extending from one apex of the triangular frame and in the same plane as the triangular frame.

A further object of the present invention is to provide a bag holder of rigid wire rod construction as set forth in the preceding object in which the triangular frame defines an isosceles triangle having an elongated straight base segment or section that can rest against the ground with the triangular frame and handle extending upwardly therefrom being maintained generally in a vertical position while material is being swept or raked into the open end of the bag through the opening defined by the triangular frame.

Another object of the present invention is to provide a bag holder in accordance with the preceding objects in which the terminal ends of the one piece bag holder have laterally inclined loops formed thereon. The loops extend laterally and upwardly from opposite sides of the handle adjacent the apex of the triangular frame from which the handle extends. Portions of the handle adjacent the loops are welded in a manner to rigidly connect the terminal ends of the one piece wire rod to the handle adjacent the apex of the frame to form a rigid, generally planar bag holder which will have no exposed sharp ends.

Still another object of the present invention is to provide a lawn and leaf bag holder in accordance with the preceding objects in which the one piece wire rod construction includes a double wire handle in the same plane as the triangular frame with the length of the handle being substantially longer than the vertical height of the triangular frame thereby enabling a person to grasp the handle and effectively utilize the holder while in a substantially erect position and enabling manipulation of the holder and bag when moving the holder and bag to different locations as may be required.

A still further object of the present invention is to provide a lawn and leaf bag holder in accordance with the preceding objects in which the one piece construction enables connection of the bag to the holder without manipulating any manually controllable clamps, adjustments and the like thereby rendering the holder easy to use on either side and less likely that separate components could become misplaced.

Yet another object of this invention to be specifically enumerated herein is to provide a lawn and leaf bag holder in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
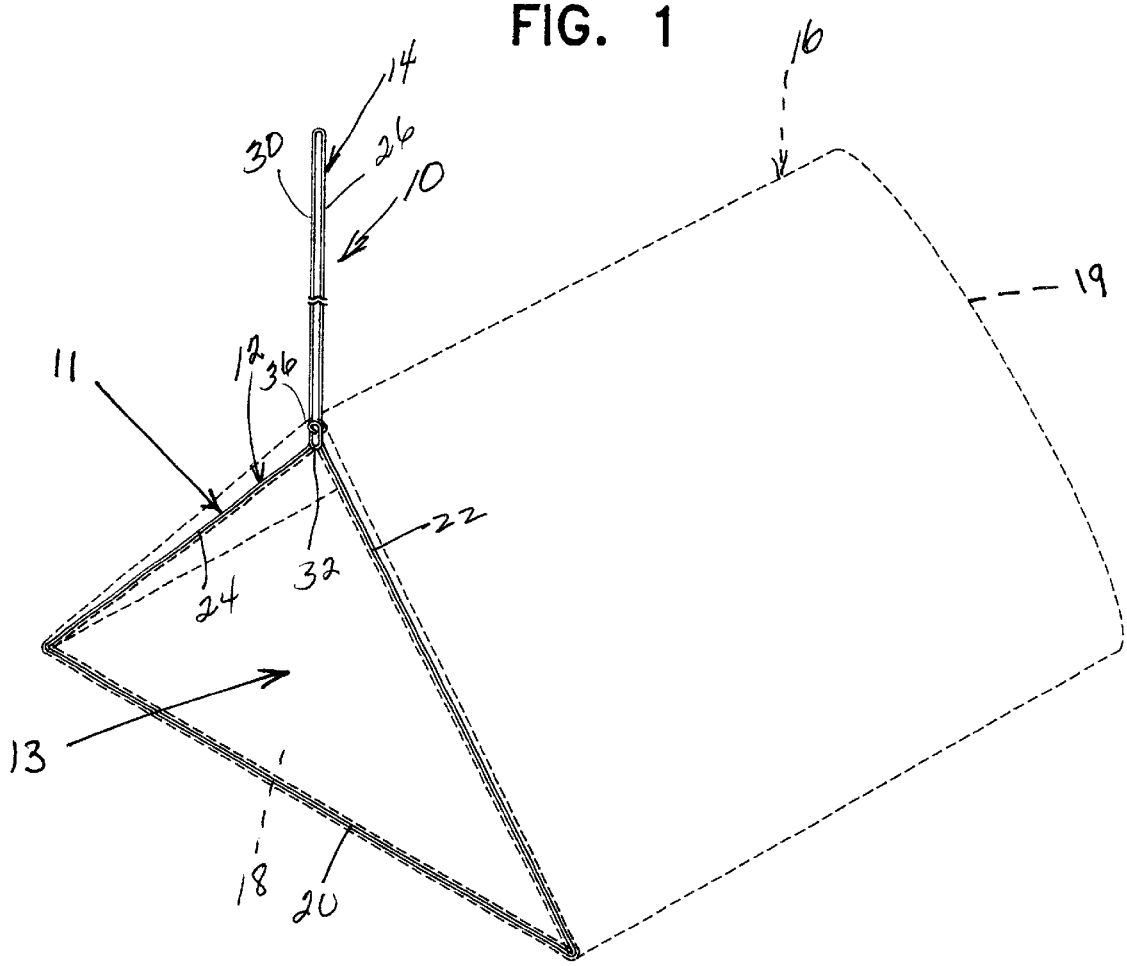
FIG. 1 is a perspective view of a lawn and leaf bag holder in accordance with the present invention associated with a flexible plastic lawn and leaf bag.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

The lawn and leaf bag holder of the present invention is generally designated by reference numeral 10 and includes a generally triangular frame 12 and a vertical handle 14 extending vertically from an upper apex of the triangular frame 12. The triangular frame 12 is associated with a plastic bag 16, preferably a standard size conventional lawn and leaf bag having an open mouth end 18 and a closed opposite end 19. The bag 16 and its peripheral walls are quite flexible thus making it difficult to place material into the open end of the bag especially when it is desired to place a portion of the open end of the bag on the ground surface and sweep or rake material into the open end of the bag.

The bag holder 10 is constructed from a single piece of wire rod of substantially rigid construction, generally designated by reference numeral 11. The single piece of wire rod 11 is bent to form the triangular frame 12 including a bottom section 20 and side sections 22 and 24 to form the triangular frame having an opening, generally designated by reference numeral 13. The side sections 22 and 24 are preferably of equal length to form the triangular frame 12 in the shape of an isosceles triangle. Further, side sections 22 and 24 are preferably shorter than the base or bottom section 20 to provide a longer section for placement adjacent the ground during leaf and debris collection.

Figure 2:
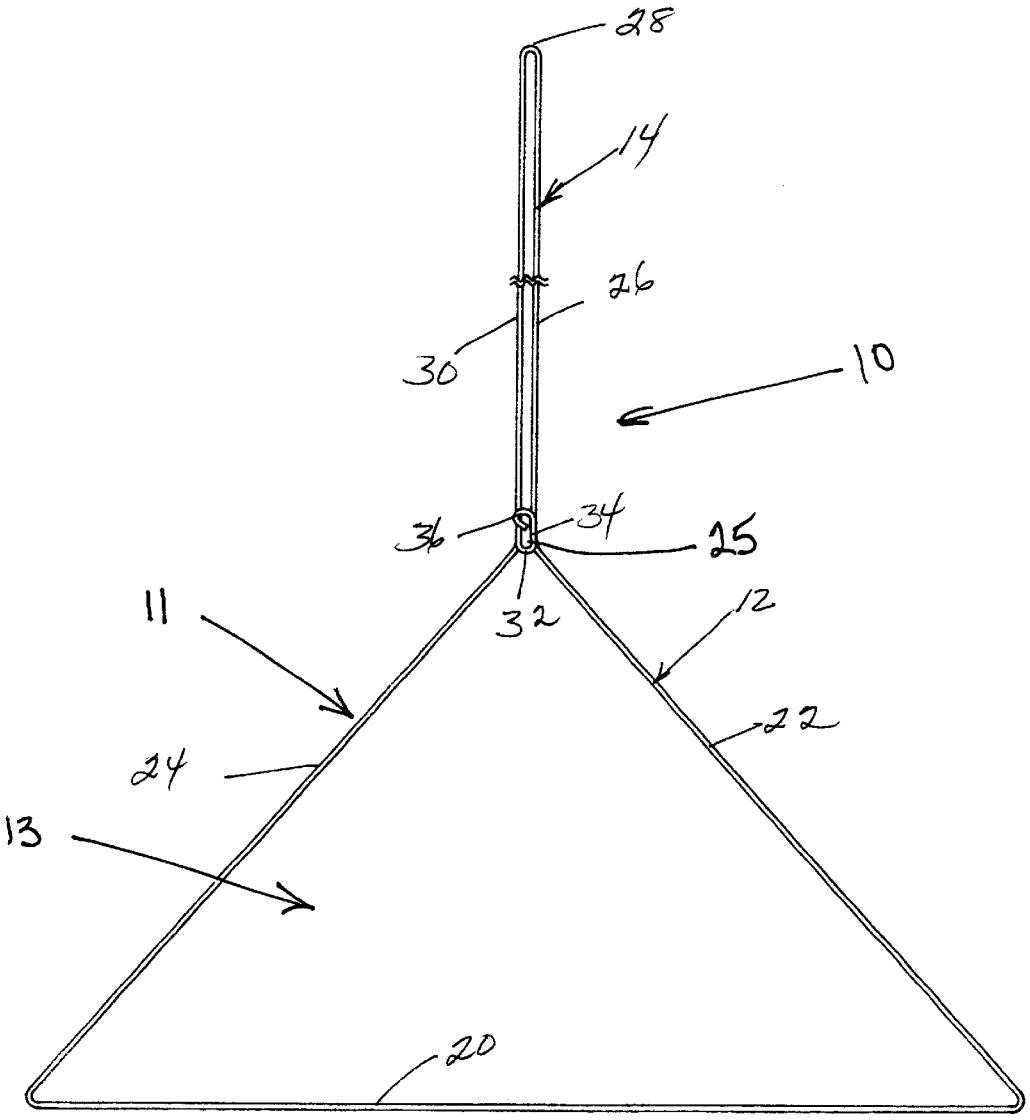
FIG. 2 is a front elevational view of the lawn and leaf bag holder shown in FIG. 1.
Figure 5:
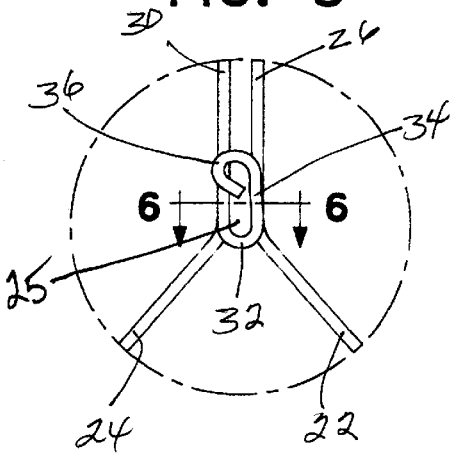
FIG. 5 is an elevational view of the loop on the opposite side of the handle of the bag holder from that shown in FIG. 4.
Figure 3:
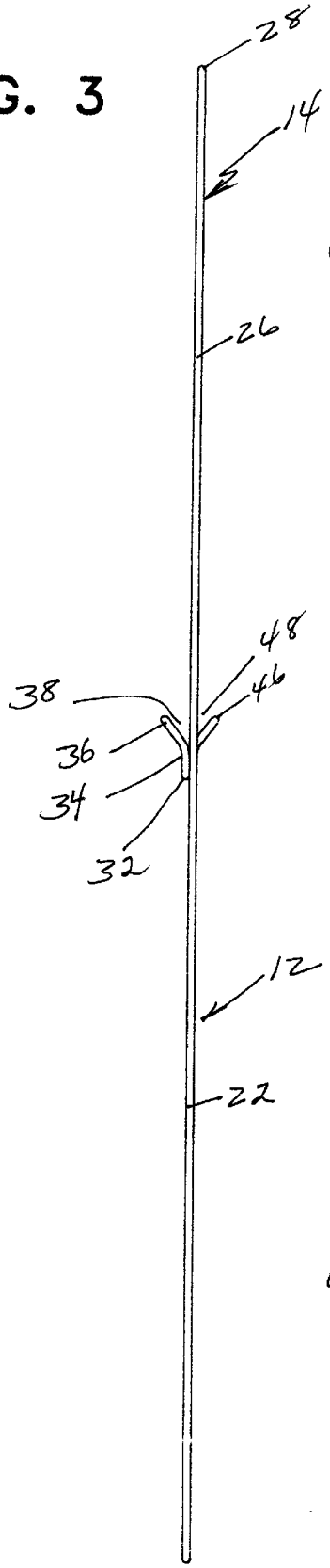
FIG. 3 is a side elevational view of the lawn and leaf bag holder shown in FIG. 1.
Figure 6:
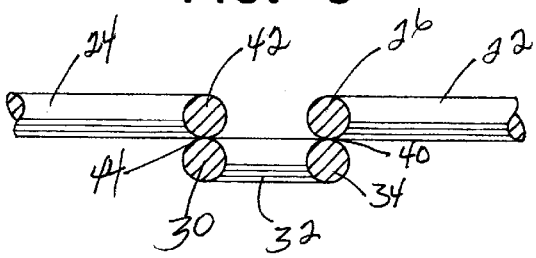
FIG. 6 is a transverse, sectional view taken along section line 6—6 on FIG. 5 illustrating the association of the components of the juncture between the triangular frame and handle and the welded structure of the loops.
Figure 7:
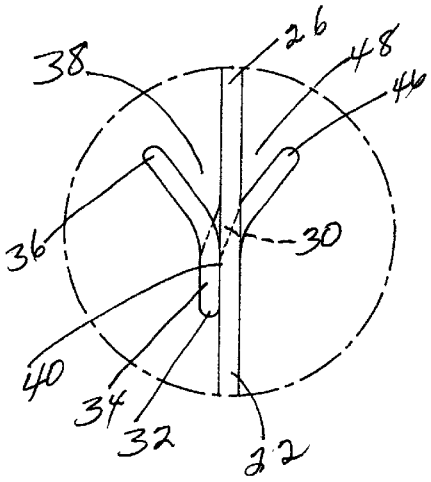
FIG. 7 is an enlarged side elevational view of the juncture between the triangular frame and handle shown in FIG. 6 and illustrating the two outwardly and upwardly inclined loops.

At the upper apex 25 of the triangular frame 12 the side section 22 continues upwardly as a side component 26 of the handle 14. At the upper end of the side member 26, the wire 11 is reversely bent into a U-shape configuration at 28. The wire rod 11 then extends downwardly as side member 30 of the handle 14 which is generally parallel to and adjacent the side member 26 as illustrated in FIG. 2. The lower end of the side member 30 terminates in a reverse bend of U-shaped configuration at 32 and extends a short distance upwardly at 34. The wire rod 11 terminates in an outwardly inclined loop 36 to form an acute angular recess 38 between the upper surface of the loop 36 and the side members 26 and 30 of the handle 14 as illustrated in FIGS. 5 and 7. The upwardly extending portion 34 between the bottom U-shaped bend 32 and the outward bend to form the loop 36 is welded at 40 to the lower end of the side member 26 of handle 14.

Figure 4:
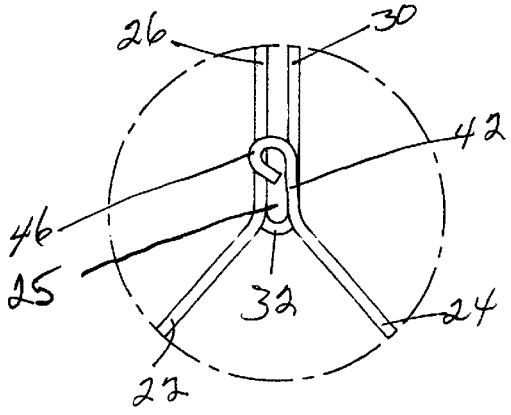
FIG. 4 is an enlarged elevational view of one of the loops at the juncture between the handle and triangular frame of the bag holder shown in FIG. 1.
Figure 8:
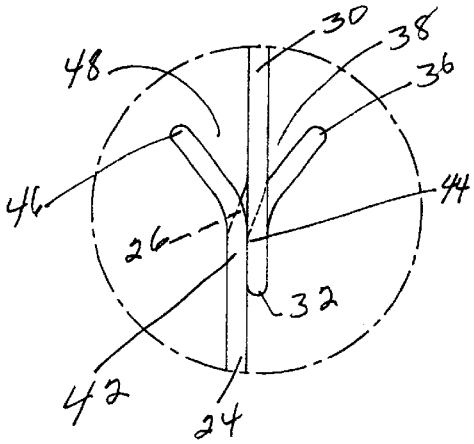
FIG. 8 is a fragmentary enlarged elevational view of the juncture and loops from the side opposite to that shown in FIG. 7.

As illustrated in FIGS. 4 and 8, the upper end of side member 24 of the triangular frame 12 includes a short upwardly extending portion 42 welded to the lower end of side member 30 of handle 14 at 44. The upper end of the portion 42 forming an extension of the side member 24 is formed into a loop 46 that is inclined outwardly and upwardly in relation to the side members 26 and 30 forming the handle as illustrated in FIGS. 4 and 8. The loop 46 and the side members 26 and 30 define an acute angular recess 48 similar to the recess 38.

This construction provides a one piece rigid structure with opposite substantially symmetrical loops 36 and 46 and angular recesses 38 and 48 which face upwardly and outwardly from opposite sides of the handle 14 and frame 12. Hence, the respective loops and recesses, 36 and 38 on one side and 46 and 48 on the other side serve as one or more anchors to retain the mouth of the plastic bag and the bag holder in assembled relation irrespective of which side of the bag holder 10 faces outwardly.

The holder 10 is constructed to hold a standard 39 gallon lawn and leaf bag in an open position. The base 20 of the holder along with a corresponding portion of the open end 18 of the bag 16 can be positioned along the ground surface as illustrated in FIG. 1 to enable a user to rake or sweep leaves, grass clippings or other lawn debris into the bag by holding a lower portion of the bag along the surface of the ground with the entrance to the bag corresponding to the configuration of the triangular frame. The holder is made from a single piece of preferably galvanized wire having a diameter ranging between about 3/16 inch and about ¼ inch that is bent to form the triangular frame handle and loops. The triangular frame has a base length preferably of about 26½ inches with the sides 22 and 24 being about 21 inches. The handle 14 is preferably about 18 inches in height from frame 12 and the loops preferably are about ¾ inch in diameter and bent at about a 30°–45° angle to the handle. The welded sections 34 and 42 are preferably about 1 inch in length. While the components of the bag holder 10 are preferably sized so that a standard 39 gallon flexible plastic lawn and leaf bag can be stretched over the outer parameter of frame 12 and secured by the loops 36 and 46 and included angles 38 and 48, the components of the bag holder 10 may be varied in order to accommodate the mouth of different sized flexible bags.

In use, a portion of the open end of the bag 16 is grasped in one hand and the bottom or base 20 and the apices of the frame at the ends of base 20 of the triangular frame 12 are inserted into the open mouth 18 of the bag 16 approximately 2 inches. This is best accomplished by resting the bag on the ground or other surface and lifting the upper portion of the open end of the bag sufficiently to insert the base of the frame into the bag. An upper portion of the open end of the bag 16 is then moved upwardly and stretched sufficiently to place the upper portion of the open end of the bag over either of loops 36 or 46. The edge of the stretched upper portion of the bag is received and retained in the included angle at 38 or 48 as the stretched edge of the open end of the bag attempts to return to its original unstretched condition. Thus, the loop 36 or 46 which receives the edge of the open end of the plastic bag will retain the bag in open position to facilitate various lawn materials being swept, raked or inserted into the bag.

Alternatively, the bag holder and bag may be assembled with the open mouth 18 of the flexible plastic bag 16 being drawn through the opening 13 of the triangular frame 12. A bottom portion of the edge of the open mouth 18 is then folded downwardly over the bottom or base section 20 and around the apices of the frame at the end of base 20. Once folded over, the holder 10 can be manipulated to press the bottom or base section 20 against the ground so as to retain the folded over edge in position. The opposite or upper portion of the edge of the bag open mouth 18 is then stretched upwardly to the upper apex 25 of the triangular frame 12 and then "tied off" by securing the edge to the loops 36, 46 and/or within the angular recesses 38, 48.

After the bag 16 has been securely connected to the triangular frame using either method of assembly, the handle 14 and the mouth 18 of the bag 16 as well as the triangular frame 12 are held in vertical position by one hand of a user while the other hand of the user can be used to sweep or rake material into the plastic bag. The holder can also be used to move the bag to new locations and enables a person to hold the bag in position by grasping the upper end of the handle. Hence, the user can remain in a more erect, comfortable position while sweeping or raking material into the bag.

The bag holder constructed in accordance with the present invention is a one piece, relatively simple bag holder with no moving components which require adjustment, manipulation and can become inoperative or misplaced during normal use. By providing loops facing in opposite directions, the user can orient the frame with either loop facing the open end of the bag when assembling the bag on the bag holder. The user may position the upper edge portion of the open end of the bag over either loop by gently stretching the open end of the bag and placing it over either loop at the apex of the frame.

The foregoing is considered as illustrative only of the principles of the invention. Further, numerous modifications and changes will readily occur to those skilled in the art. For example the side sections 22 and 24 need not be straight, but could be arcuate. Similarly, the loops 36 and 46 are preferred, but the wire ends could be differently configured to tie off the bag open mouth. Also, the sides 26 and 30 of handle 14 do not need to be straight. Lastly, although not preferred, the frame 12 and handle 14 could be made from more than a single wire rod, hence, it is not desired to limit the invention to the exact construction and operation shown and described, and all suitable modifications and equivalents may be resorted to, falling within the scope of the invention.

What is claimed as new is as follows:

1. A holder for standard plastic lawn and leaf bags comprising an open triangular frame having a base section for positioning an edge of an open mouth of said bag along a ground surface, an elongated handle connected to and extending upwardly from said frame, said frame and said handle aligned substantially in the same plane, said frame including a pair of upwardly converging first and second side sections forming an upper apex of said frame, said first side section of said frame extending laterally from the apex of said frame to form a first side member of said handle, said first side member of said handle being reversely bent at an outer end thereof and forming a second side member of said handle, said second side member of said handle extending toward the apex of said frame in closely spaced parallel relation to said first side member of said handle, said second side member of said handle terminating in a reverse bend U-shaped loop including a short lateral portion overlying and rigidly fixed to a portion of said first side member of said handle adjacent the apex of said frame, said second side section of said frame terminating in a short lateral portion overlying and rigidly fixed to a portion of said second side member of said handle adjacent the apex of said frame thereby rigidly interconnecting said side members of the handle and side sections of the frame adjacent the apex of the frame, each of said short lateral portions terminating in a reverse bend forming a laterally extending substantially closed loop, said substantially closed loops being disposed on opposite sides of said handle in planes diverging from said handle to form oppositely facing bag anchors with each anchor including an acute angular recess between the plane of the side members of said handle and the planes of said substantially closed loops for securing an opposite portion of said bag open end.

2. The holder as defined in claim 1, wherein said frame and handle are constructed of a single piece of substantially rigid wire.

3. A bag holder comprising an open frame defined by a peripheral member, a handle laterally extending from said frame, said handle and frame positioned in the same plane and being constructed of a single piece of wire rod, said frame including a straight bottom section for positioning along a ground surface, and a pair of upwardly converging first and second side sections forming an upper apex of said frame, said first side section of said frame extending laterally from the apex of said frame to form at least a portion of said handle, and said second side section connected to said first side section adjacent said apex to form an anchor for engaging a portion of an open end of a bag in opposed relation to peripheral portions of the open end of the bag engaged with said frame for holding the bag in an open position with the straight bottom section of the frame and open end of the bag being positioned along a ground surface to enable a user to sweep or rake material into the bag, said first side section of said frame that extends laterally from said apex forming a first side member of said handle, said first side member of said handle being reversely bent at an outer end thereof and forming a second side member of said handle, said second side member of said handle extending toward the apex of said frame in closely spaced parallel relation to said first side member of said handle, said second side member of said handle terminating in a reverse bend U-shaped loop including a short lateral portion overlying and rigidly fixed to a portion of said first side member of said handle adjacent the apex of said frame.

4. A bag holder comprising an open frame defined by a peripheral member, a handle laterally extending from said frame, said handle and frame positioned in the same plane and being constructed of a single piece of wire rod, said frame including a straight bottom section for positioning along a ground surface, and a pair of upwardly converging first and second side sections forming an upper apex of said frame, said first side section of said frame extending laterally from the apex of said frame to form a first side member of said handle, said first side member of said handle being reversely bent at an outer end thereof and forming a second side member of said handle, said second side member of said handle extending toward the apex of said frame in closely spaced parallel relation to said first side member of said handle, and said second side member of said handle terminating in a reverse bend U-shaped loop including a short lateral portion overlying and rigidly fixed to a portion of said first side member of said handle adjacent said apex to form an anchor for engaging a portion of an open end of a bag in opposed relation to peripheral portions of the open end of the bag engaged with said frame for holding the bag in an open position with the straight bottom section of the frame and open end of the bag being positioned along a ground surface to enable a user to sweep or rake material into the bag, said second section of said frame terminating in a short lateral portion overlying and rigidly fixed to a portion of said handle adjacent the apex of said frame thereby rigidly interconnecting said handle and side sections of the frame adjacent the apex of the frame, said short lateral portion of said second section of said frame terminating in a reverse bend forming a laterally extending substantially closed loop, said substantially closed loops being disposed on opposite sides of said handle in planes diverging from said plane of said frame and said handle to form oppositely facing bag anchors with each anchor forming an acute angular recess between said plane of said handle and frame and said planes of said substantially closed loops.

* * * * *